United States Patent [19]

Fisher et al.

[11] 4,116,273

[45] Sep. 26, 1978

[54] INDUCTION HEATING OF COAL IN SITU

[76] Inventors: Sidney T. Fisher, 2850 Hill Park Rd.; Charles B. Fisher, 53 Morrison Ave., both of Montreal, Quebec, Canada

[21] Appl. No.: 709,830

[22] Filed: Jul. 29, 1976

[51] Int. Cl.[2] ..... E21B 43/24; E21C 41/10

[52] U.S. Cl. ..... 166/248; 166/256; 166/302; 299/2

[58] Field of Search ..... 166/248, 256, 259, 302, 166/303, 50, 57, 60; 299/2, 14; 219/10.41, 10.57, 10.75, 10.79, 277, 278; 48/DIG. 6

[56] References Cited

U.S. PATENT DOCUMENTS

| | | | |
|---|---|---|---|
| 2,472,445 | 6/1949 | Sprong | 166/60 |
| 2,634,961 | 4/1953 | Ljungstrom | 166/302 |
| 2,856,292 | 10/1958 | Mann et al. | 219/10.41 X |
| 2,859,952 | 11/1958 | Tour et al. | 299/14 |
| 2,923,535 | 2/1960 | Ljungstrom | 166/256 |
| 2,939,689 | 6/1960 | Ljungstrom | 166/60 X |
| 3,379,248 | 4/1968 | Strange | 166/256 |
| 3,472,987 | 10/1969 | Viart | 219/10.41 |
| 3,727,982 | 4/1973 | Itoh et al. | 299/14 |

*Primary Examiner*—Stephen J. Novosad
*Assistant Examiner*—George A. Suchfield
*Attorney, Agent, or Firm*—Barrigar & Oyen

[57] ABSTRACT

The electric induction heating in situ of a selected portion of an underground coal deposit, for the purpose of facilitating extraction of gases, liquids, solids and energy from the deposit. The heating is conveniently effected by passing a time-varying electrical current through a conductor encompassing the selected portion. The conductive path is preferably a toroid, quasi-toroid, helix, or simulated toroid, quasi-toroid or helix, created by a drilling and passing one or more conductors through the drill holes.

16 Claims, 13 Drawing Figures

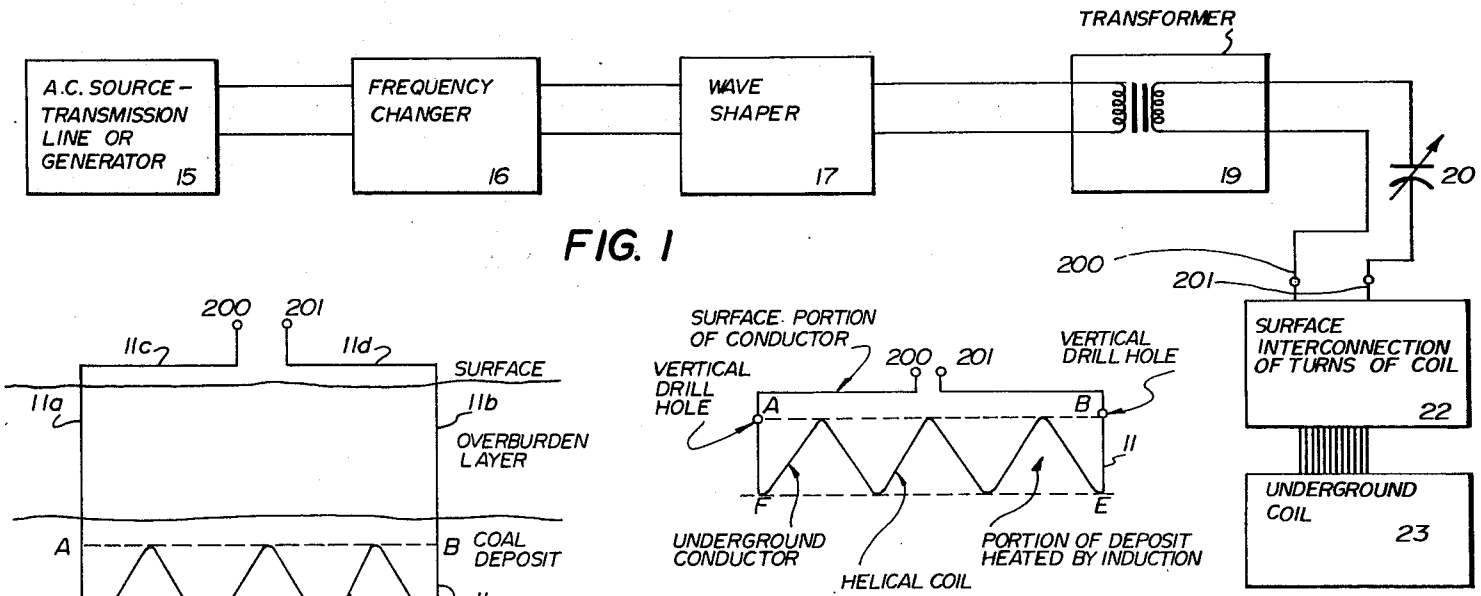
A.C. SOURCE - TRANSMISSION LINE OR GENERATOR
15
FREQUENCY CHANGER
16
WAVE SHAPER
17
TRANSFORMER
19
20
200
201
SURFACE INTERCONNECTION OF TURNS OF COIL
22
UNDERGROUND COIL
23
VERTICAL DRILL HOLE
SURFACE PORTION OF CONDUCTOR
VERTICAL DRILL HOLE
UNDERGROUND CONDUCTOR
HELICAL COIL
PORTION OF DEPOSIT HEATED BY INDUCTION
A
B
E
F
11
FIG. 1
FIG. 3
SURFACE
OVERBURDEN LAYER
COAL DEPOSIT
ROCK FLOOR
HELICAL COIL
PORTION OF DEPOSIT HEATED BY INDUCTION
11a
11b
11c
11d
A
B
C
D
FIG. 2

INDUCTION HEATING OF COAL IN SITU

FIELD TO WHICH THE INVENTION RELATES

The present invention relates to a method of heating an underground deposit of coal by electric induction heating, for the purpose of facilitating extraction of useful energy or matter from the deposit.

BACKGROUND OF THE INVENTION

Roughly one half of the world's known coal deposits are located in North America and coal is the major fossil fuel resource of both North America and the world. There are two well known methods of mining coal. Coal deposits of great thickness at or near the surface are exploited by strip mining, and such deposits may account for five to ten percent of the known reserves. Strip mining generally causes serious environmental degradation, in that the top soil is removed and covered, the surface and under-surface drainage of the land is seriously disturbed, and strongly acidic compounds are commonly leached out of the material exposed after the overburden and coal are removed. Ecological restoration of the land is very expensive, and is rarely fully successful. The tendency is to regard the area mined as a sacrifice to economic necessity because of the large time lag, the high cost and doubtful result of land restoration after trip mining. Strip mining represents a destruction of the environment which is increasingly regarded as unacceptable. Secondly, where coal deposits are at a considerable depth, one thousand feet being typical, conventional deep mining techniques must be resorted to. The mining of coal deposits too deep to be stripped of overburden is costly and requires a large amount of manual labour. Coal mining is inevitably accompanied by a high incidence of accidents, caused largely by rock falls and gas explosions. In addition, the coal dust in the mine atmosphere causes severe lung problems, and it is well known that many coal miners are afflicted by black-lung disease. Furthermore, deep mining of coal is inefficient in that about only half of the coal is extracted, and that most of it is not mined at all, the seams being either too thin or too deep to permit economic working. There is also severe ecological degradation associated with deep mining. This is principally due to the amount of rock brought to the surface with the coal, and coal dust or other fumes.

In summary, present coal-exploitation methods are costly, dangerous, cause severe environmental damage, and extract only a small percentage of the total deposits. It is of greatest importance that coal be efficiently utilized but this is not possible with present methods of mining.

SUMMARY OF THE INVENTION

The present invention is the electric induction heating of selected portion of an underground coal deposit. Electric induction heating of the selected portion of the underground coal deposit may be effected by passing a selected time-varying electric current through an underground conductor or plurality of conductors whose path or paths are chosen to substantially encompass the volume of the coal deposit intended to be treated. By "substantially encompassing" is meant the surrounding of the volume by the conductive path so as to generate, when a selected time-varying electric current is passed therethrough, an electromagnetic field sufficiently strong throughout at least a substantial portion of the encompassed volume to enable it to be heated satisfactorily by induction to a desired temperature. If the location and shape of the conductive path are appropriately chosen, heat will be generated within substantially the entire mass of the encompassed volume of the coal deposit, and thus the temperature of substantially the entire mass of the deposit portion being treated can eventually be raised to a level sufficient to enable at least an economically significant portion of the gases, liquids, solids and energy which are generated by the heating of coal to be extracted. Once the temperature of the underground coal deposit has reached the desired level, the gases, liquids, solids and energy may then be extracted using extraction technology already known or yet to be developed. The present invention, however, is not directed to the extraction process which follows the heating of underground coal deposits; the present invention is confined to the induction heating technique per se, which will then be followed or accompanied by a suitable extraction process (it is contemplated that the heating by induction may continue during at least some portion of the time required for extraction of the products and energy resulting from the heating of coal).

Drilling techniques are known whereby other than straight vertical drill holes may be formed in the earth. Such known drilling techniques may be utilized to create an appropriate underground path for one or more conductors used to carry the selected time varying electrical current to effect the induction heating of a portion of an underground coal deposit substantially encompassed by the conductor or conductors. In many conventional electric induction heating applications, a helical coil or wire is used, and the contents of the volume substantially encompassed by the helix are then heated by induction for the particular purpose which the designer has in mind. Ideally, a toroid-shaped conductor coil configuration would be utilized, since a toroidal coil avoids the end losses associated with a helix. If a helix is used, then to avoid the difficulty and expense of drilling continuously curved paths, it is possible to simulate a helical path underground by means of interconnected straight line drill holes at appropriate angles to the vertical and meeting the surface at various preselected points, through which drilled passages a conductor or plurality of conductors may be fed and joined together by conventional techniques so as to create a continuous conductive path which will surround an economically significant volume of a selected underground coal deposit. A selected time-varying current caused to flow through this conductive path will then heat by induction the coal located within the volume substantially encompassed by the conductive path. In a similar matter, passages may be drilled to accommodate a toroidal, quasi-toroidal or simulated toroidal or quasi toroidal conductor path within the underground coal deposit. The selected time-varying voltage and current and the time during which they are applied are selected to raise the temperature of the mass of coal substantially encompassed by the conductive path to a desired temperature sufficient to permit the extraction of the gases, liquids and energy produced by the heating of coal.

As mentioned above, electrical induction heating of coal may also be effected by the use of a quasi-toroidal configuration of conductor turns. The following discussion is intended to fully describe a quasi-toroidal coil.

A surface of revolution is surface generated by revolving a plane curve about a fixed line called the axis of the surface of revolution.

A conventional torus is a surface of revolution generated by a circle offset from the axis, which circle, when it moves about the axis through 360°, defines the toroidal surface. The section of the torus is the circle which generated it. The inner radius of the torus is the distance between the axis and the nearest point of the circle to the axis, and the outer radius of the torus is the distance between the axis and that point on the circle most remote from the central axis. When a coil of wire is formed havng the overall shape of torus, the coil is said to form a "toroidal conductive envelope", since it envelopes a generally toroidal space. Toroidal inductor coils are well known in electrical engineering. Conventionally, a continuous coil of wire is formed into a torus thereby forming a toroidal envelope having a circular section. Since the coil is a continuous conductor, it follows that the turns of which the toroidal coil are formed are series connected. Such a toroidal coil has a desirable property that its electromagnetic field is substantially confined to the interior of the torus. The quasi-toroidal embodiments of the present invention are not concerned with true toroidal envelopes but rather with quasi-toroidal envelopes formed by a plurality of discrete interrupted turns lying at different angles so as to approximately surround the volume lying within the envelope. By "interrupted turn" it is meant a turn having a discrete discontinuity small with respect to the length of the turn.

A first distinction between a quasi-toroidal envelope and a toroidal envelope is that the turns of the quasi-toroidal envelope do not necessarily form a complete closed curve as is the case (except for the terminals) in a toroidal envelope, but instead each takes the form of an interrupted turn — i.e. a curve which includes a discontinuity (there must necessarily be an electrical discontinuity in order that electric current may be passed through the quasi-toroidal envelope from one side of the discontinuity to the other).

A further point of distinction is that a quasi-toroidal envelope need not be a surface of revolution, nor does its section have to approximate a circle. A quasi-toroidal surface includes not only surfaces of revolution formed or approximated by rotation of an interrupted circle about an axis but also any practicable topological equivalent thereof, such as a surface of revolution generated by an interrupted rectangle, or such surface "stretched" generally perpendicular to the axis so that an oblong or slab shaped surface results. Because of the difficulty of drilling curved tunnels underground, a rectangular coil configuration is preferred, comprising only substantially only horizontal and vertical conductive elements. (The "horizontal" conductors may depart from the horizontal to follow the upper and lower boundaries respectively of the coal deposit.)

A characteristic of a quasi-toroidal conductor configuration (and indeed also of a toroidal inductor) is that the electromagnetic field is highest near the inner radius of the quasi torus and therefore the coal may be expected to heat more quickly at the inner radius than at the outer radius. This implies that an increasing current will be required in the quasitoroidal coil to maintain the field strength sufficient to heat at constant power the coal lying towards the outer radius of the quasi-toroid. Eventually the required current may become intolerable, and in the absence of corrective measures, the operation would have to come to a halt.

It is accordingly further proposed in the quasi-toroidal embodiment of the present invention that progressive extension of the quasi-toroidal conductor configuration to quasi-toroidal structures of increasing radius be utilized to facilitate extraction of the products and energy generated by the heating of coal from large underground volumes. If the conductors are arranged initially in a twelve sided array, this configuration can continue to be maintained as the quasi-toroidal radius is increased up to some convenient maximum radius.

In a preferred embodiment of the invention, a central vertical shaft is excavated from the ground surface to the bottom of the underground deposit or some other convenient point within the coal deposit. Vertical shafts or drill holes are also sunk at locations corresponding generally to the apexes lying on a circumscribing circle of a twelve-sided figure whose centre is located generally at the centre of the central vertical shaft. From a point within the central shaft located at or near the top of the underground coal layer, horizontal tunnels are excavated radially outward towards each of the vertical shafts. These horizontal tunnels can be continued to a radius to be a suitable maximum.

If a twelve-turn configuration is to be used, the angle between adjacent horizontal tunnels will be 30°. Twelve vertical shafts or drill holes are arranged at about 20–30 feet from the central vertical shaft. This would enable the vertical and horizontal conductive elements placed in the central shaft, in the vertical drill holes and in the horizontal tunnels, to encompass an annular quasi-toroidal portion of the deposit lying between the central shaft and the spaced drill holes, and lying between the upper and lower tunnels, which latter as indicated above are suitably placed prespectively at the upper and lower extremities of the coal deposit.

If it is assumed that the innermost quasi-toroid is defined by the central shaft of radius about 5 feet and a twelve-sided array of vertical drill holes at about 20–30 feet from the central shaft, the next step is to arrange a further pattern of drill holes to intercept the continuation of the horizontal tunnels at a further distance from the central shaft than were the first set of drill holes. The next set of vertical drill holes, for example, might be located at a distance of say 150–200 feet from the center of the central shaft. If a further set of turns beyond the 150–200 feet distance is to be provided, the next succeeding set of drill holes might be located at, for example, 1000–1200 feet from the central shaft. At that distance from the central shaft, the working of an underground deposit would be expected to take several years.

The reason for the foregoing spacing of vertical drill holes is this. In a toroidal or quasi-toroidal conductor configuration, the electromagnetic field strength is highest near the inner extremities of the turns of the coil and lowest near the outer extremities of the turns of the coil. As a consequence, the coal near the inner coil extremities will be heated first, and heating will occur progressively outwardly from the innermost coils to a point at which further economic recovery from the deposit becomes impracticable. As coal is heated, in say the inner quasi-toroidal envelope region, the current required to heat the coil becomes increasingly high since the amount of conductive material lying within the electromagnetic field generated by the conductive turns becomes increasingly small. Eventually a point is FIG. 21 is a side elevational view, partially broken away and in section and showing a portion of the apparatus of FIG. 18;

FIG. 22 is a fragmentary front elevational view of an in-breathing valve which is illustrated in FIGS. 2 and 3 of the drawings; and FIG. 23 is a vertical fragmentary sectional view of the valve combination of FIG. 22.

DETAILED DESCRIPTION

Referring now in more detail and by reference characters to the drawings which illustrate preferred embodiments of the present invention, A designates an emergency breathing apparatus comprising a main frame 10 with a hood 12 disposed over and connected to the frame 10 in a manner to be hereinafter described.

The main frame 10 is more fully illustrated in FIGS. 2 and 3 of the drawings. The main frame 10 comprises a pair of essentially inverted, somewhat U-shaped frame sections 14 and 16, the frame section 14 of which is designed to be worn over and engageable with the breast portion of the individual and the frame section 16 designed to be worn over and engageable with the upper back of the individual when the apparatus A is donned.

Each of the frame sections 14 and 16 are formed of steel hollow tubes, thereby creating interior oxygen containing chambers 18, and these chambers 18 are integrally closed at the pair of opposed upper ends of the tubes, although closure could be accomplished by means of caps, or similar forms of fittings. In this respect, the main frame 10 internally contains its own oxygen chambers 18, thereby eliminating the necessity of the individual carrying a source of oxygen, as for example, a cylinder of oxygen attached in the form of a backpack. Moreover, the oxygen can be stored under pressure in the chambers 18 to an extent sufficient to enable at least a 15-minute or greater source of oxygen supply. In like manner, the oxygen could exist in the form of an oxygen containing gas, or other source which is capable of rendering oxygen.

The two frame sections 14 and 16 are hingedly connected together at their upper extremities by means of hinge springs 22. These hinge springs are designed to bias the two frame sections 14 and 16 to the closed position, as illustrated by the phantom lines in FIG. 2. Moreover, these two frame sections 14 and 16 can be pulled to the open position, where both such frame sections 14 and 16 are illustrated in solid lines in FIG. 2. In this same respect, the frame sections 14 and 16 could be cambered if desired, in the plane of the U-shaped portions of these two sections 14 and 16 in order to properly fit over the wearer's chest and upper back.

The hinge spring 22 is more fully illustrated in FIG. 4 of the drawings and generally comprises a coiled section 24 having downwardly and outwardly struck arms 26. The lower ends of the arms 26 are integrally provided with coiled attachment ends 28 which are tightly wound about and are thereby rigidly secured to the upper ends of each of the tubes forming part of each of the frame sections 14 and 16. Thus, it can be observed that the spring 22 serves both as a hinge and as a bias to press the frame sections 14 and 16 together.

The biasing action of the spring 22 serves to hold the hood 12, which is disposed upon the frame 10, together and flat for the purposes of stowage and, in addition, to hold the hood firmly to the wearer's body. In addition, it can be observed that the top portion of the frame section 14 and 16 do not contact each other when the lower portion is in the collapsed condition, as illustrated in the phantom lines of FIG. 2 of the drawings.

The hood 12 is more fully illustrated in FIG. 1 of the drawings, and the hood 12 is preferably formed of a fireproof fabric material of the type well-known in the art. Thus, the hood could be formed of a canvas material impregnated with a suitable fire retardant organophosphorous compound.

By further reference to FIG. 1, it can be observed that the hood 12 includes a head section 30 which extends downwardly as far as the shoulders of an individual and is integrally provided with a back section 32 and a front section 34 extending downwardly to approximately the lower ribs of the front and back of the individual. In this respect, the size of the hood 12 is based on the size of a well-built, approximately six-foot tall man. In this way, the hood is capable of being used on relatively large individuals and is also capable of being adjusted so that it can accommodate various sized individuals, in a manner as hereinafter described. The hood 12 is also provided with a harness 35 for securement about the torso of an individual.

At its upper end, the hood is provided with a relatively thick reinforcing and head protective liner which may be in the form of a discrete shield 36 (FIG. 19). This shield 36 may be formed of steel, or other form of strong metal, or plastics or reinforced plastics, and attached to the inner surface thereof in order to serve as a form of crash helmet. This shield 36 will be attached by any suitable means, such as adhesive or the like, or otherwise effectively sewn into the liner portion of the hood 12. This shield may be in the form of a multiplicity of discrete segments, as shown in FIG. 19, to facilitate stowage by permitting folding of the hood section 30. On the inner side of the shield 36 is a foam rubber cushion 37, as is normal in crash helmets, to distribute the forces imposed on the shield uniformly on the head of the wearer.

The head section 30 of the hood 12 is provided on its front face with an enlarged aperture having a flexible transparent plastic sheet 38 disposed over the aperture and serving as a window, as illustrated in FIGS. 18 and 19. The margins of the sheet 38 are secured to the material forming part of the hood 12 by means of seams, adhesives or the like. Due to the fact that most of these transparent plastics which serve as a window are flammable, a copper gauze flame arrestor 40 extends over the plastic sheet 38 and is also secured to the exterior surface of the head section 30. This gauze flame arrestor also serves as a heat dissipator.

Located beneath the transparent sheet 38 which serves as a window are two substantially identical outbreathing valves 42 (FIGS. 18 and 19) which are basically low-pressure one-way valves used on all forms of breathing apparatus. These valves 42 are essentially conventional in their construction, and are sewn or otherwise adhesively secured to the fabric forming the hood 12. The actual location of the breathe-out valves 42 is not critical, although two such valves 42 should be spaced on opposite sides of the hood 12 to preclude against the inlet of one of these valves being blocked by a fold in the fabric, particularly when the hood is used on a child or an infant.

A threaded recess 45 is provided in the front leg 34 and is essentially located at chest level to receive a screw-in type chemical gas filter 44. This chemical filter 44, which is illustrated in FIG. 21, is again an essentially conventional structure and is similar to those forms of filters used on gas masks for use in areas containing poisonous gases.

A communications system is provided by two speaker-microphone sets 46 and 48, as illustrated in FIGS. 1 and 19 of the drawings. It can be observed that one of these speaker-microphone sets faces inwardly with respect to the hood 12 and the other faces outwardly with respect to the hood 12. In this way, one of these sets serves to permit the user of the apparatus to speak and the other of the sets permits the user of the apparatus to hear another individual. In this respect, the inwardly facing speaker-microphone set 46 must be located near the mouth of the individual in order to operate as a microphone. The outwardly facing set 48 is not critical in its location with the exception that it should enable the user of the apparatus to hear external sounds introduced therein, and should therefore generally face in the same direction as the wearer of the apparatus.

A simple external switch (not shown) allowing two levels of amplification of the voice could also be incorporated if desired. In this respect, the speaker-microphone sets 46 and 48 may be powered by a small DC battery (not shown) which may be attached to the interior surface of the fabric forming part of the hood, preferably in the region of these two sets 46 and 48. This battery may preferably adopt the form of a so-called "pen-like battery". In addition, the speaker-microphone sets 46 and 48 would be operable upon the opening of the frame through a limit switch 50, as shown in FIG. 4, which would thereby energize the two sets 46 and 48 upon opening of the frame. Accordingly, power drainage from the battery is thereby avoided.

The fabric forming part of the head section 30 includes an inwardly extending section 52 forming a neck-receiving aperture 54, in the manner as illustrated in FIGS. 18 and 19 of the drawings. The internal tailoring of the fabric forming part of the hood 12 is designed to drape over the shoulders of the individual and enclose the neck in a continuous aperture 54 in order to form a gas-tight breathing plenum 58 around the head of the individual. An extensible, resilient band 56 (FIG. 19) is formed around the aperture 54 so as to engage the neck of the individual, and thereby form the air-tight plenum 58 around the head of the individual using the apparatus A. The band 56 is formed of a rubber-like material which is fairly elastic so that when the hood is pulled over the head of the individual, the rubber-like material is extensible enough to slip over the head and resilient enough to seal in a gas-tight manner around the neck of the individual.

In this case, the band 56 is sized so that it will actually form an air-tight seal even around a child's neck. Also located around the aperture 54 in relationship to the band 56 is a tie-string (not shown) which is normally in a slack condition sufficient that the band 56 will stretch over an adult's head without impediment. Moreover, when the apparatus A is used as a form of a bag to carry a baby, the hood is inverted with the baby resting on the crown 36 of the hood 12. In this case, the tie-string is pulled tight to close off the neck aperture in a gas-tight arrangement. Thus, the baby will be completely enclosed within the plenum, but which will nevertheless be provided with a source of oxygen for normal breathing.

Referring again to FIGS. 2 and 3, it can be observed that each of the frame sections 14 and 16 are comprised of a pair of vertically extending tubular arms 62 (often referred to herein as "tubes") which are connected by a bight portion 64. Extending across the two essentially vertically disposed arms 62 on the rear frame section 16 is a retaining plate 66 which carries a pressure regulator 68, or so-called "oxygen flow regulator" and which is essentially located in the region of the small of the back of the individual. The regulator 68 is essentially a conventional structure of the simple continuous flow type, which is preset to provide a sufficient flow of oxygen for a full-grown man at an active exertion level.

A control valve or so-called "oxygen cut-off valve" 70 (FIG. 4) is mounted on one of the frame sections 16 for permitting a flow of oxygen to the plenum chamber 58. The oxygen cut-off valve 70 is in fluid communication with and connected to the regulator 68 to cut-off the flow of oxygen from the chambers 18 to the regulator 68 by means of a tube 72. Extending from the oxygen flow regulator 68 is an oxygen supply pipe 73 which is connected to a discharge manifold 108, as hereinafter described in more detail. The valve 70 is supplied with oxygen from the internal chambers 18 through an oxygen delivery tube 75 which is in fluid communication with the internal chambers 18 containing the oxygen or other form of oxygen containing gas contained within the chambers 18. The tube 75 is provided with an extension 76 which extends into the chamber 18, as illustrated in FIG. 5, and which extension 76 is provided with an inlet aperture 77.

The bias created by the spring 22, as mentioned above, serves to hold the two frame sections 14 and 16 together for purposes of stowage. Nevertheless, the frame sections 14 and 16 can be spread to the open condition where they are essentially 30° apart with respect to the upper ends thereof. However, it is to be noted that the cut-off valve 70 is closed when the two frame sections 14 and 16 are in the closed position, so that oxygen does not escape from the tubes forming part of the frame sections 14 and 16. When the two frame sections 14 and 16 are spread apart, the cut-off valve 70 will open, thereby permitting oxygen contained within the chambers 18 of the frame sections 14 and 16 to pass into the valve 70 and into the regulator 68 and into the manifold 108 and thence into the plenum 58.

In accordance with the above, it can be observed that the oxygen cut-off valve 70 is closed when the apparatus is not in use, that is when the two U-shaped frames 14 and 16 are pressed together. By further reference to FIG. 4, it can be observed that a pulley 80 is operatively connected to the oxygen cut-off valve 70 through a shaft 82. The shaft 82 is internally connected to the cut-off valve 70 in such a manner that it will open and close the valve 70 upon rotation of the pulley 80. A cable 84 is trained around the pulley 80 and is connected to the frame section 14.

Thus, the donning of the hood over the head of the user performs two major functions when the two frames 14 and 16 are spread apart to the open condition. First of all, the oxygen is automatically turned on into the breathing plenum 58 through the regulator 68. This action results through the rotation of the pulley 80, opening the valve 70, inasmuch as the pulley 80 is operatively connected to the frame section 14 through the cable 84. In addition, the communications system including the microphone sets 46 and 48 is automatically energized. It can be observed by reference to FIG. 4, that since the communications system is provided with the on/off limit switch or microswitch 50, when the two frame sections 14 and 16 are pressed together, the FIG. 7 illustrates schematically an embodiment of an inner quasi-toroidal envelope constructed in accordance with the present invention. Within a coal deposit, inner vertical conductor segments 1 are connected by upper horizontal conductor segments 3 and lower horizontal conductor segments 4 to outer vertical conductor segments 2 and 5. Upper horizontal conductor segments 3 are connected to vertical conductor segments 5. In FIG. 7, by way of example, twelve turns are illustrated, each turn being composed of three vertical conductor segments 1, 2 and 5 and two horizontal conductor segments 3 and 4 so as to form a substantially rectangular turn. The turns are arranged at angles of about 30° to one another. It will be noted that the turns do not comprise complete turns. There is a discontinuity present at the outer upper corner of each rectangular turn. This of course is essential in order that current flow around the parallel connected, series connected or series-parallel connected rectangular turns. The term "interrupted turn" is sometimes used herein to indicate that such a discontinuity is present.

Vertical conductor segments 2 and 5 extend above the surface of the ground where various interconnections hereinafter described and depicted in FIG. 8 may be made in the surface interconnection unit 22 of FIG. 1. The dotted lines of FIG. 7 illustrate the case where the turns of the coil are connected in series. The input terminals 200 and 201 of the coil configuration are connected to the control system circuitry of FIG. 1 (not shown in FIG. 7).

When alternating current is applied to terminals 200 and 201, an electromagnetic field is generated by the rectangular turns of the coil. The electromagnetic field tends to permeate a quasi-toroidal space which differs from true toroidal space not only because of the drop off in field between conductive turns (especially at their outer extremities) but also because of the interrupted rectangular coil configuration in distinction from the usual circle coil configuration which would appear in conventional small scale toroidal inductors. The quasi-toroidal space has an inner radius defined by the radius of the notional circle on which the junction points of conductors 1 with conductors 4 lie. The outer radius of the quasi-toroidal space is defined by the outer vertical conductor segment 2. The upper limit of the quasi-toroidal space is defined by a notional horizontal annular surface in which the upper conductor segments 3 lie. A similar notional annular surface in which the lower conductor segments 4 lie defines the lower boundary of the quasi-toroidal space. Thus the turns formed by the inner and outer vertical conductor segments 1, 2 and 5 and the upper and lower horizontal conductor elements 3 and 4 together form a quasi-toroidal envelope which substantially surrounds the quasi-toroidal space defined above. Obviously the more turns that are used in the envelope, the more closely the actual electromagnetic field will extend throughout the entire quasi-toroidal space surrounded by the envelope. However, bearing in mind that tunnelling or drilling is required for the introduction of each of the conductor elements into an underground carbon deposit, a trade off must be made between efficiency of generation of the electromagnetic field within the quasi-toroidal space and the economics obtained by minimizing the number of holes or tunnels drilled or excavated. In the discussion which follows it will be assumed that the number of turns of the quasi-toroidal coil is twelve. However, some other number of turns may be utilized in appropriate situations, and empirical evaluation of the effectiveness of the number of turns initially employed will undoubtedly be made in particular applications to determine whether a greater or fewer number of turns may be suitable. Obviously additional tunnels and drill holes can be provided to increase the number of turns as required. Since the detailed design in no way affects the principles herein disclosed, the examples shown in the drawings must not be considered unique.

The surface interconnection unit 22 of turns of the coil of FIG. 1 is elaborated upon in FIG. 8. Numerals 200 and 201 correspond to the input to the surface interconnections 22 of FIG. 1.

FIG. 8 shows in schematic form the twelve turn coil of FIG. 7, with the turns connected in six possible ways. In detail A the twelve turns are connected in series, as in FIG. 7; in detail B six series connections each of two turns in parallel are provided; in detail C, four series connections each of 3 turns in parallel; in detail D, 3 series connections each of 4 turns in parallel; in detail E, 2 series connections each of 6 turns in parallel; and in detail F a single path of twelve turns in parallel. The tabulation below shows that these provide a relative inductance range of 144 to 1, (and therefore a relative resonating capacitance range of 1 to 144) and this wide range permits convenient choices of other circuit parameters in a great variety of coal deposits.

| Turn Connections | Relative Inductance | Relative Max Currents | Relative Resistance |
|---|---|---|---|
| A | 144 | 1 | 144 |
| B | 36 | 2 | 36 |
| C | 16 | 3 | 16 |
| D | 9 | 4 | 9 |
| E | 4 | 6 | 4 |
| F | 1 | 12 | 1 |

FIG. 9 shows a schematic elevation view of two turns of the coil in FIG. 8 with the central vertical shaft 9, the horizontal tunnels 10, and the vertical drill holes 11 through which the conductors are threaded. The surface interconnection unit 22, drawn from one of the options of FIG. 8, is also shown.

The resistivity of dry coals at 20° C. ranges from $10^{10}$ to $10^{14}$ ohm cm. However, the resistivity decreases exponentially with temperature and reaches about 5 ohm cm at 900° C. It may be useful to take advantage of this property of coal before induction heating is initiated. Referring to FIG. 9, oxygen or other suitable gas or liquid is injected at the inner face of the portion of the deposit to be heated. Here, the central shaft 9 of FIG. 9 or drill holes 23 (as seen in FIG. 10) at the inner radius of a quasi-toroidal coil would be so injected. Next, the coal along the inner face or drill holes is ignited. This reduces the resistivity of the coal at the drill hole or inner face. Thus, when induction heating is commenced, by applying current to the turns of the coil, large currents will flow more readily because of the greatly reduced resistivity. The induction heating will then spread outwardly from the inner face or drill holes so ignited and heated. In FIG. 9, this would be from shaft 9 outwards.

For the reasons previously discussed, there is a practical upper limit on the ratio of the outer radius of the quasi-toroidal envelope defined by the vertical conductors 2 of FIG. 9 to the inner radius of the quasi-toroidal envelope defined by the location of the inner vertical conductor segments 1 of FIG. 9. For this reason it may be desirable to provide a further quasi-toroidal envelope surrounding that illustrated in FIGS. 7 or 9. Such further quasi-toroidal envelope could utilize as its innermost vertical conductor elements the conductor elements 2 of FIGS. 7 or 9. Mathematical studies have shown that the ratio of the outer radius of the quasi-toroidal envelope to the inner radius of the quasi-toroidal envelope should not be greater than about 5 or 6 for best results. If this limit is observed, the efficiency of the induction heating process is greatly increased, since the ohmic losses in the coil conductors are kept to a low value, and the energy is principally expended in heating the coal.

FIG. 10 is a schematic elevation view of the conductor paths which may be used for a four phase coal heating operation. A central shaft 9 of radius about five feet is sunk from the surface through the overburden 20, and through the coal deposit 21. Two sets of equally spaced radial horizontal tunnels 22 of say 40 inch diameter are drilled from the central shaft 9. One set of radial horizontal tunnels 22 is located at the upper face of the coal deposit 21. The second set of horizontal tunnels 22 is located at the lower face of the coal deposit 21. Next, four sets of vertical drill holes 23 are sunk from the surface through to the bottom of the coal deposit 21. Each set consists of twelve vertical drill holes 23 equally spaced about the circumference of a circle and located so as to intersect the upper and lower horizontal tunnels 22. Each vertical drill hole has a radius of about 16 inches. The number of sets of vertical drill holes is dependent upon the extent of the coal deposit. For illustrative purposes, four sets have been described here.

FIG. 11 is a schematic plan view of the configuration of FIG. 10 illustrating the vertical drill holes 23. Four sets of vertical drill holes 23 are depicted. The inner set of twelve vertical drill holes 23 lies upon the circumference of a circle of radius 20–30 feet. The second set lies on a circle of radius 100–200 feet; the third set on a circle of radius 500–1200 feet and the fourth set on a circle of radius about 2500–7200 feet. The dashed lines of FIG. 11 show the horizontal tunnels 22. There are twelve such tunnels at the upper face of the coal deposit and twelve more at the lower face. Obviously, both sets of tunnels cannot be shown in a plan view.

FIG. 12 is a schematic elevation view showing the conductors of one turn of the coil within the vertical drill holes, central shaft and horizontal tunnels. The cross-hatched area 9 depicts the central shaft. The solid lines illustrate a conducting element located within a horizontal tunnel, vertical drill hole or central shaft. A dashed line represents such a tunnel, drill hole or central shaft with no conductor.

With respect to detail A of FIG. 12 a single turn of the coil is shown. It is preferable to install the conductors for all four phases of the coal heating operation before beginning to heat the first phase. In the first phase, represented by detail A, the inner vertical conductor segment 1 is connected to the lower horizontal conductor segment 4. Segment 4 is connected to outer vertical conductor segment 2. Vertical conductor segment 1 is connected to upper horizontal conductor 3 and the latter is connected to vertical conductor segment 5. Conductors 2 and 5 are connected to the surface connection arrangement of FIG. 8. The inner radius of the phase 1 coil is about five feet corresponding to the radius of the vertical central shaft 9. The outer radius of the phase 1 coil is 20–30 feet. Power is applied to the coil to initiate the heating of the coal.

When heating of the coal deposit lying within the conductor segments 5, 3, 1, 4 and 2 has been completed, phase 1 of the coal heating operation is finished and phase 2 shown in detail B of FIG. 12 may be begun. In detail B of FIG. 12 conductor segments 2, 30, 31, 32 and 33 are connected so as to form one turn of the electrical induction coil. The phase 2 coil has an inner radius of 20–30 feet and an outer radius of 150–200 feet. Note that conductor segment 2 is used for both phase 1 and phase 2.

In a similar fashion, the necessary changes being made, phase 3 and 4 follow phases 1 and 2. Detail C and detail D of FIG. 12 illustrate the interconnection of the conductors for phases 3 and 4. As each phase is completed, the conductors unused in the preceding stage may if desired be disconnected and withdrawn for use elsewhere. It will be noted that the coil connections are brought out at each second drill hole along the radius shown in FIG. 12. The changing of connections between successive phases is therefore facilitated. The arrangement of the installation in a concentric configuration has two important advantages: it permits the utilization of the vertical drill holes and coil conductors twice, for the outer conductors of one stage and the inner conductors of the succeeding stage; and heat transmitted outwardly from any phase is utilized in the succeeding phase. It will be noted that no coil connections are made at the upper end of the central shaft 9 of FIG. 11. This is desirable, since this shaft among others is utilized for the eduction of the gas, and other products which result from the heating of coal. If necessary, other vertical drill holes could be sunk to provide paths for the removal of the gases.

FIG. 13 is a schematic plan view of a method for heating an extensive region of an underground coal deposit which involves the simultaneous, sequential, or simultaneous and sequential heating of two or more portions of a deposit. By way of example, four sets of concentric underground coils as discussed above with reference to FIGS. 10, 11 and 12 are shown. Each set is placed within a circular area, area 1, area 2 and area 3. Here, by way of example, a sixteen turn coil is shown. The small circles show the vertical drill holes 23 of FIG. 11. The dotted straight lines depict underground horizontal tunnels 22 of FIG. 11. The four annular regions are also shown by way of example.

Within each area, heating will progress outwardly into the coal deposit by changing the coil connections found in FIG. 12. It is thus seen that the use of four sets of concentric coils permits a much larger volume of coal to be heated than would be the case if only one area at a time is processed.

For the sake of completeness, a possible extraction method for use with the invention will now be described. The particular extraction method chosen is at the discretion of the user and is not a part of this invention per se.

Coal and lignite are classed as intrinsic semiconductors, as are the other fossil fuels-oil-sand, oil-shale, petroleum, etc., and have the electrical conductivity (or resistivity) variations characteristic of this class of materials. The specific electrical resistivity of all dry coals is extremely high at 20° C. in the range of $10^{10}$ to $10^{14}$ ohm cm, with the anthracites near the upper limit and the lignites near the lower limit. The resistivity decreases exponentially with the absolute temperature, and for all coals reaches a value of the order of 5 ohm cm at about 900° C. temperature. In order to heat coal effectively by electrical induction it may be useful to take advantage of this great reduction in resistivity at an elevated temperature. Before the electrical induction heating cycle is begun, therefore, and after the electrical conductors are in place, oxygen or other suitable material is injected through drill holes at the inner face of the annulus which is to be processed, and the coal in these drill holes is ignited. The ensuing combustion quickly raises the temperature of a thin layer of coal at each drill hole, and reduces its resistivity to a low value. As soon as this has been accomplished, the oxygen supply or other suitable material is discontinued, and the electrical current is applied to the turns of the underground coil. The magnetic field induces eddy currents mainly in the high-temperature low-resistivity area surrounding each drill-hole, and the induction-heating spreads from these focus points, to form a continuous cylindrical shell.

When coal is heated to 400° C. and above, coal gas and coal tar are evolved. At first, in the range 400° C.–500° C. coal tar is produced. Above, 500° C., coal gas is generated. The increased temperature also serves to convert the liquid coal tar to a gaseous form. The gases are led to the surface through the central shaft used in the case of the quasi-toroid and the vertical drill holes where they are collected and separated into their constituents.

When the gases have been evolved, the residual deposit within the ground consists primarily of coke. Upon removing the coil conductors, air or oxygen may be injected into the coke. Combustion will ensue with great quantities of carbon dioxide being formed. The carbon dioxide may be led to the surface where it may be used to drive a turbine.

A great deal of the heat produced during the combustion process is retained underground by the overburden. Said heat may be removed by a heat exchanging process such as injecting low temperature steam into the ground and removing it as high temperature steam to drive a steam turbine.

In every case the vertical drill holes, horizontal tunnels and central shaft (for the case of a quasi-toroid) are used to lead the various gases to the surface.

The possible method of use delineated above optimally represents a virtually complete removal of the gaseous products and energy from a coal deposit. No mining is necessary and the entire sequence of events occurs above the site of the coal deposit.

Variations and modifications in the above-described specific techniques and configurations will occur to those skilled in the art. The present invention is not to be restricted thereby but is to be afforded the full scope defined by the appended claims.

We claim:

1. A method for heating a selected portion of an underground deposit of coal which comprises the step of directly heating said selected portion by electrical induction heating.

2. In the conditioning of a selected naturally-occurring coal deposit to facilitate extraction of hydrocarbons and other products therefrom, the improvement comprising the direct electrical induction heating of a selected portion of said coal deposit in situ over a period of time so as to heat such portion to a temperature lying within a selected range of temperatures.

3. The method of claim 2, wherein the heating is effected by means of a selected time-varying voltage and current, passed through a conductor substantially encompassing said selected portion.

4. The method of claim 3, wherein the conductor forms loops or turns each of which substantially surrounds part of said selected portion.

5. The method of claim 4, wherein the path of the conductor defines a helix or toroid.

6. The method of claim 4, wherein the conductor comprises connected segments approximating a helix or toroid.

7. A method of heating in situ a selected portion of an underground coal deposit, comprising:

(a) disposing at least one electrical conductor in at least one underground path whose shape and location are chosen to form, when voltage is applied across the ends of said conductor, an electric circuit substantially encompassing said portion; and (b) passing a selected time varying electric current through said conductor of a magnitude and for a time selected to heat said portion by induction to a selected temperature.

8. A method of heating a selected portion of an underground coal deposit in situ comprising:

(a) forming a quasi-toroidal conductor arrangement in the deposit substantially to envelope the said selected portion, and (b) applying a selected time varying current and voltage, to the conductor arrangement to heat the selected portion by induction heating to a selected temperature.

9. A method as defined in claim 8, wherein the ratio of the outer radius to the inner radius of said quasi-toroidal conductor arrangement does not exceed 10:1.

10. A method as defined in claim 8, wherein the ratio of the outer radius to the inner radius of said quasi-toroidal conductor arrangement is of the order of 5:1.

11. A method as defined in claim 8, comprising forming within the deposit a second quasi-toroidal conductor arrangement whose inner radius is substantially the outer radius of the first-mentioned quasi-toroidal conductor arrangement, and applying a selected time varying current and voltage to the second conductor arrangement to heat the coal deposit therein to a selected temperature.

12. A method as defined in claim 11, wherein the ratio of the outer radius to the inner radius of each said quasi-toroidal conductor arrangement does not exceed 10:1.

13. A method as defined in claim 11, wherein the ratio of the outer radius to the inner radius of each said quasi-toroidal conductor arrangement is of the order of 5:1.

14. A method as defined in claim 11, wherein the individual turns of each said quasi-toroidal conductor arrangement are of interrupted rectangular configuration.

15. The method as defined in claim 8, wherein the individual turns of the quasi-toroidal conductor arrangement are of interrupted rectangular configuration.

16. A method as defined in claim 8 wherein after the electrical conductor arrangement is in place and before electrical induction heating is begun, a combusting agent is injected into the portions of the coal deposit adjacent the inner conductors of said quasi-toroidal conductor arrangement and said portions are ignited to reduce the resistivity of uncombusted portions adjacent thereto.

* * * * *

UNITED STATES PATENT AND TRADEMARK OFFICE

CERTIFICATE OF CORRECTION

PATENT NO. : 4,116,273

DATED : September 26, 1978

INVENTOR(S) : Sidney T. Fisher, et al

It is certified that error appears in the above—identified patent and that said Letters Patent is hereby corrected as shown below:

Delete columns 5-12 to insert the attached columns 5-12 respectively therefor.

Signed and Sealed this

*Nineteenth* Day of *August 1980*

[SEAL]

*Attest:*

SIDNEY A. DIAMOND

*Attesting Officer*

*Commissioner of Patents and Trademarks* reached at which the coils become too hot or the current becomes too high to permit any further heating of coal. This point is determined in part by the ratio of the diameter of the inner set of conductor coil segments to the diameter of the outer conductive coil segments. Another reason for the necessity of increasing the effective inner and outer radius of the quasi-toroidal coil being utilized is that after the generation of the gases from the heated coal deposit, the residue consists of coke. Further hearing of the coke serves no purpose and the presence of the coke serves to diminish the penetration of the magnetic field into the, as yet, unprocessed coal deposits lying at greater distances from the central shaft than the coke residue. The simplest method to achieve an adequate magnetic field intersection with unprocessed portions of the coal deposit is to step up to a larger quasi-toroidal coil having increased inner and outer radius so as to envelope the unprocessed coal regions.

Studies performed on mathematical models indicated that at least for some significant underground western coal deposits, the ratio of the outer envelope radius to inner envelope radius for the quasi-toroidal envelope should never exceed about ten, with a ratio nearer to 5:1 or 6:1 being preferred. For example, this means that if the radius of the central shaft is substantially the inner radius of the innermost quasi-toroidal envelope, then the innermost quasi-toroidal envelope should have an outer radius of the order of five or six times that of the radius of the central shaft. The next adjacent toroidal envelope may have an inner radius of say five or six times the central shaft radius and an outer radius of say 25 to 36 times the central shaft radius, and so on progressively outwards until some maximum radius is reached representing the economical upper limit for the working of the particular coal deposit in question.

It will be seen from the foregoing that if as few as twelve turns are used, the effect of the electromagnetic field produced by the coil necessarily deviates from the field that would be produced if a much larger number of turns were used to define the envelope. The term "quasi-toroidal" used in the specification is intended to embrace the approximation to a true annular volume or envelope within the electromagnetic field generated by a coil consisting of a relatively small number of conductive turns, usually fewer than twenty and in the examples to be considered, twelve, permeates.

The progressive heating proposal according to the invention i.e. the progressive utilization of quasi-toroidal envelopes of increasingly large radii, results in a saving in drilling and in conductor utilization, since at least some of the innermost vertical conductor elements of an outer quasi-toroidal envelope can conveniently be the outermost vertical conductive elements of the next adjacent inner quasi-toroidal envelope. Furthermore, the horizontal tunnelling can be relatively easily accomplished at the outset for the entire set of horizontal tunnels, because the horizontal conductive elements of the outer quasi-toroidal envelope, or at least some of them, are conveniently formed in alignment with the horizontal conductive elements of the inner quasi-toroidal envelope, thus enabling the same horizontal tunnelling to be used to place the conductors. (In some circumstances, it may be desirable to increase the number of turns as the outer radius of the quasi-toroid increases.)

The literature reports that the resistivity of coal drops rapidly as the temperature of the coal increases. Assuming this to be the case, it is further proposed according to this invention that oxygen, air or some other suitable material be injected into the vertical drill holes which are located on the inner radius of the quasi-toroidal coil or into the central vertical shaft of the quasi-toroidal coil and ignited. The ensuing combustion quickly raises the temperature of a thin layer of coal at the central vertical shaft or at the drill holes and the resistivity of the coal decreases. A lower resistivity permits larger induction currents to flow at the drill holes or central shaft. The induction heating will spread from these areas to form a continuous cylindrical shell.

SUMMARY OF THE DRAWINGS

FIG. 1 is a schematic drawing of the electrical circuitry used for the the input of the induction heating coil and the control system.

FIG. 2 is a schematic elevation view illustrating a conductive path and associated surface electrical equipment for use in heating by induction of a selected portion of a coal deposit, wherein a helical coil is employed.

FIG. 3 is a schematic plan view of the conductive path and surface connections therefor illustrated in FIG. 2.

DETAILED DESCRIPTION WITH REFERENCE TO THE DRAWINGS

Figure 4:
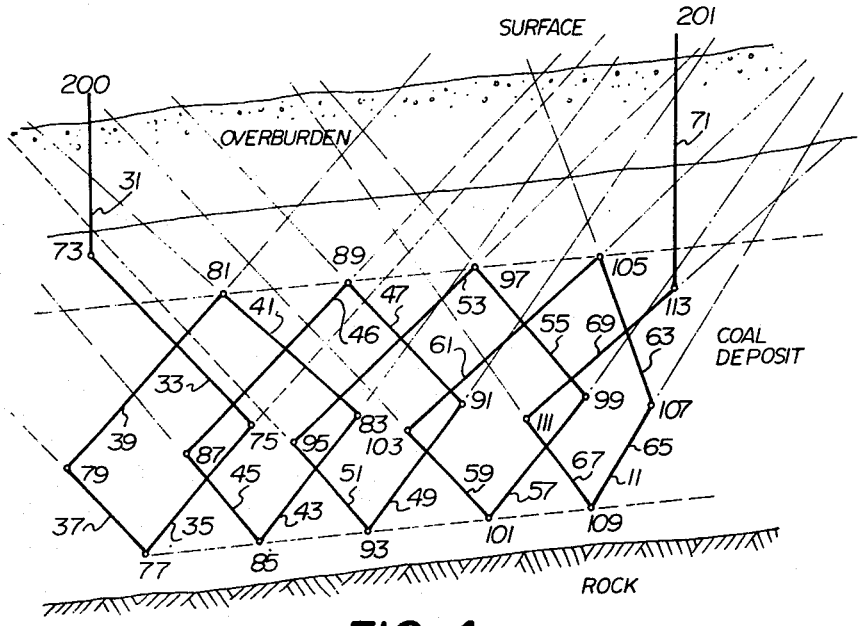
FIG. 4 is a schematic view illustrating in a pattern of straight line drill holes so located as to enable the simulation of the conductive path of FIG. 2.

FIG. 1 illustrates the surface control system circuitry common to any type of underground coil configuration. Alternating current input 15 from an AC generator or a transmission line drives a frequency changer 16 and wave shaper 17 connected to the primary winding of a transformer 19. Transformer 19 is a step down transformer intended to supply a relatively low voltage high amperage current to the underground coil configuration and is ordinarily located close to the surface interconnection unit 22 of turns of the coil.

A capacitor 20 is connected to the surface interconnection unit 22 and hence to the underground induction coil (which, because of its shape, has appreciable inductance) in order to resonate the underground coil 23 at the frequency selected for operation. In a series resonant circuit the positive reactance of the coil is numerically equal to the negative reactance of the capacitor 20, and the combined impedance is purely resistive, equal to the ohmic resistance of the coil plus the resistance reflected into it from the resistivity to eddy currents of the portion of the coal deposit encompassed by the induction heating coil. The resonating capacitor 20 is employed only when the current wave form applied to the coil 23 is sinusoidal or near sinusoidal. When a square or nearly square wave form is employed, no resonating capacitor 20 is employed, and the positive reactance of the induction heating coil 23 remains uncancelled.

It is expected that with experimental testing, the inductive heating effects in the coal deposit will be found to be dependent upon the frequency of alternating current passed through the underground coil, and also upon the shape of the wave form of the current (and indeed may vary with the temperature and other parameters as the underground mass is heated). For this reason, the frequency changer 16 and wave shaper unit 17 are shown in order that alternating current of the desired frequency and wave shape be supplied to the underground coil. If, however, experimentation reveals that the frequency and wave shape of the current supplied by the high voltage alternating current generator or transmission line 15 is satisfactory, the frequency changer 16 and wave shaper unit 17 could be omitted and the generator or transmission line 15 connected directly to the transformer 19. (In North America it would ordinarily be expected that the AC generator of transmission line 15 would carry current having a frequency of 60 Hz and a sinusoidal wave form).

The surface interconnection of unit 22 for the turns of the coil is further illustrated by FIG. 8 and is applicable usually to the quas-toroidal coil hereinafter discussed. Connections 200 and 201 represent the junction between the interconnected turns of the induction coil and the secondary of transformer 19 and capacitor 20. For the case of the helical induction coil (FIGS. 2–6), the interconnections are not usually made because all turns of the coil 23 are normally in series. However, parallel or series parallel connections of the turns of the helical coil could be made in the manner described in FIG. 8 for the quasi-toroid. FIGS. 2, 3, 4 and 5 illustrate a helical coil with series connected turns so that the surface interconnection unit 22 of Figure 1 is not employed. The helical coil of FIG. 6 does employ surface interconnection unit 22.

In FIG. 1, the number of connections between surface interconnection unit 22 and the underground coil 23 depends on the manner of connections and on the number of turns of the coil. Arbitrarily, twelve connections corresponding to twelve turns of a coil have been shown. The exact number depends on the operating structure and parameters for the particular case.

In FIG. 2, a coal deposit is shown located between an overburden layer and a rock floor. Within the coal deposit, an electrical conductor 11 forms a generally helical path substantially econompassing the volume ABCD within the said deposit. (In the plan view of the same region illustrated schematically in FIG. 3, the same volume is identified by the letters ABEF.) At each end of the helix, the conductor 11 extends vertically upwards to the surface of the ground along paths 11*a*, 11*b* respectively which, at the surface, extend along surface paths 11*c*, 11*d* respectively to the control system circuitry of FIG. 1, at 200, 201.

A cylindrical helical coil configuration is frequently found in industrial induction heating apparatus because the electromagnetic field is strongest within such helix and decreases in intensity outside the coil. Thus if the material located within the volume encompassed by the helix is relatively uniform, the induction heating energy can be expected to be transferred to substantially all the material encompassed by the coil. The above is true also of a toroidal coil, and the toroid avoids the end losses associated with a helix. If the economics of the situation warrant it, a toroid (or simulated toroid) could be used instead of a helix. The rate of absorption of energy from the helical conductive path increases with the intensity of the electromagnetic field generated, and also increases with the conductivity of the energy absorbing material located within the helix. The rate of absorption of energy also increases with increasing frequency, within certain limits. There may also be an optimum frequency for energy absorption of any given conditions, which optimum frequency may conceivably vary over the duration of the heating and extraction processes.

Figure 5:
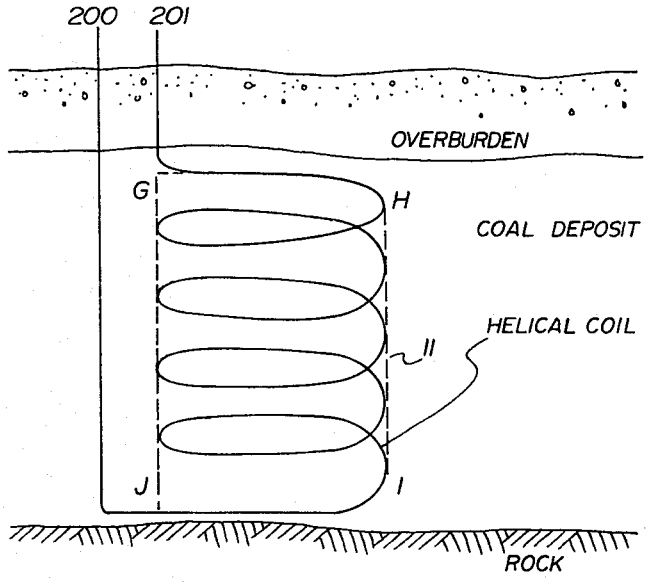
FIGS. 5 and 6 are schematic perspective views of alternative underground conductive paths for the induction heating of a selected portion of a coal deposit in accordance with the principles of the present invention.

A helix oriented in a direction perpendicular to the orientation of the helix of FIGS. 2 and 3 might perhaps be more easily formed than that of FIGS. 2 and 3. FIG. 5 illustrates such a helical path substantially encompassing and intended to heat by induction the volume GHIJ.

In any event, the helix of FIGS. 2 and 3 may be simulated by a number of interconnected straight line conductive paths which can be formed in the manner illustrated by FIG. 4. The conductive paths of FIG. 4 are formed in interconnected straight line drill holes. Vertical drill holes 31 and 71 are formed. Drill holes 33, 35, 37, 39, 41, 43, 45, 46, 47, 49, 51, 53, 55, 57, 59, 61, 63, 65, 67, and 69 are formed at appropriate angles to the surface to enable these drill holes to intersect one another and with holes 31 and 37 at points 73, 75, 77, 79, 81, 83, 85, 87, 89, 91, 93, 95, 97, 99, 101, 103, 105, 107, 109, 111, and 113, thereby forming the simulated helical path commencing at point 73 and ending at point 113. Conductors may be located along the appropriate portions (viz. between points of intersection and between the surface points 73, 113) of the aforementioned drill holes and interconnected at the aforementioned points of intersection so as to form a continuous conductive path beginning with vertical segment 31 and ending with vertical segment 71.

Figure 6:
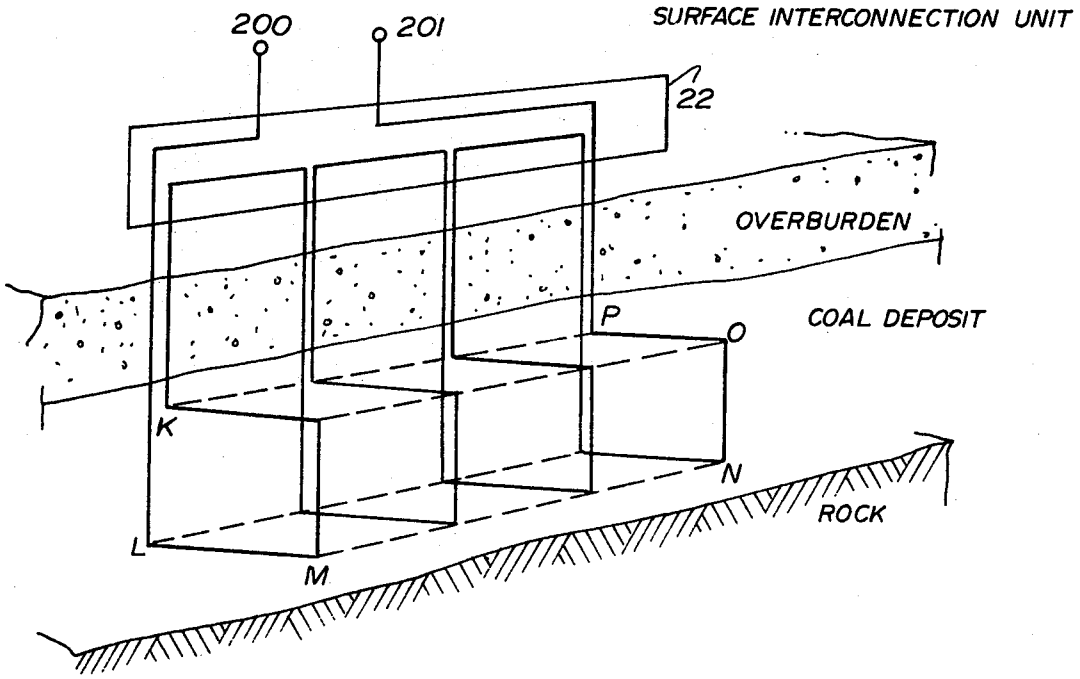

Alternatively a series of generally rectangular conductive loops may be formed, each loop located within a plane, the planes of the loops being parallel to one another, so as to define an encompassed volume KLMNOP, as illustrated schematically in FIG. 6. These rectangular loops of course will remain open at some point, e.g. at a corner, so as to enable current to flow around the loop. The loops are then connected at the surface interconnection 22 in the manner illustrated in FIG. 6 to form a continuous circuit from terminal 200 to terminal 201. Other possible arrangements of interconnected series or parallel connected loops will readily occur to those skilled in the art.

In each of FIGS. 2 through 6, the junctions 200, 201 represent the connection points between the underground induction coil and the circuitry of FIG. 1.

Alternatively, a quasi-toroidal coil configuration may be utilized for the induction heating of an underground coal deposit.

Figure 7:
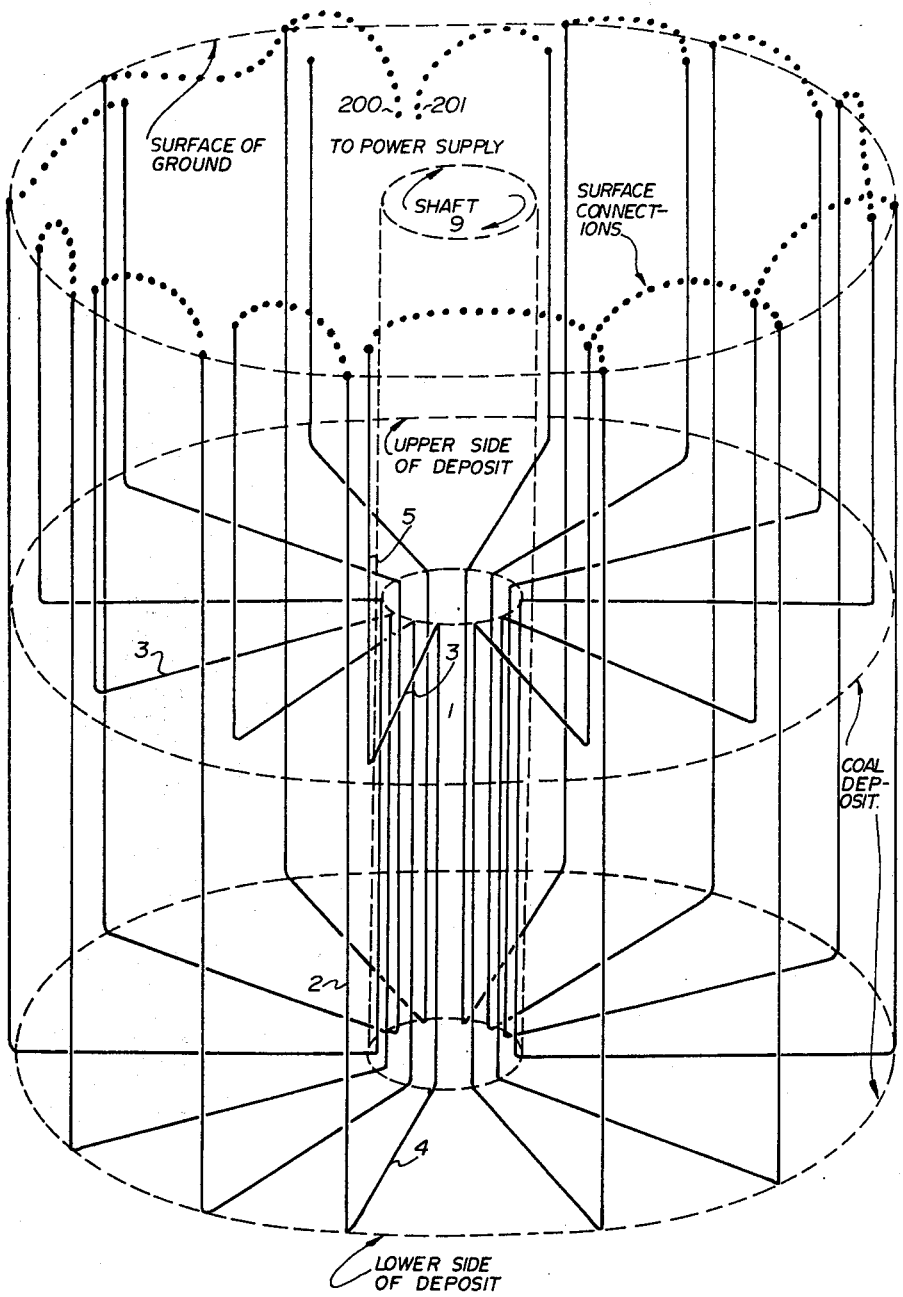
FIG. 7 is a schematic perspective view of a typical conductive path and surface connection wherein a quasi-toroidal conductor path is employed.

FIG. 7 illustrates schematically an embodiment of an inner quasi-toroidal envelope constructed in accordance with the present invention. Within a coal deposit, inner vertical conductor segments 1 are connected by upper horizontal conductor segments 3 and lower horizontal conductor segments 4 to outer vertical conductor segments 2 and 5. Upper horizontal conductor segments 3 are connected to vertical conductor segments 5. In FIG. 7, by way of example, twelve turns are illustrated, each turn being composed of three vertical conductor segments 1, 2 and 5 and two horizontal conductor segments 3 and 4 so as to form a substantially rectangular turn. The turns are arranged at angles of about 30° to one another. It will be noted that the turns do not comprise complete turns. There is a discontinuity present at the outer upper corner of each rectangular turn. This of course is essential in order that current flow around the parallel connected, series connected or series-parallel connected rectangular turns. The term "interrupted turn" is sometimes used herein to indicate that such a discontinuity is present.

Vertical conductor segments 2 and 5 extend above the surface of the ground where various interconnections hereinafter described and depicted in FIG. 8 may be made in the surface interconnection unit 22 of FIG. 1. The dotted lines of FIG. 7 illustrate the case where the turns of the coil are connected in series. The input terminals 200 and 201 of the coil configuration are connected to the control system circuitry of FIG. 1 (not shown in FIG. 7).

When alternating current is applied to terminals 200 and 201, an electromagnetic field is generated by the rectangular turns of the coil. The electromagnetic field tends to permeate a quasi-toroidal space which differs from true toroidal space not only because of the drop off in field between conductive turns (especially at their outer extremities) but also because of the interrupted rectangular coil configuration in distinction from the usual circle coil configuration which would appear in conventional small scale toroidal inductors. The quasi-toroidal space has an inner radius defined by the radius of the notional circle on which the junction points of conductors 1 with conductors 4 lie. The outer radius of the quasi-toroidal space is defined by the outer vertical conductor segment 2. The upper limit of the quasi-toroidal space is defined by a notional horizontal annular surface in which the upper conductor segments 3 lie. A similar notional annular surface in which the lower conductor segments 4 lie defines the lower boundary of the quasi-toroidal space. Thus the turns formed by the inner and outer vertical conductor segments 1, 2 and 5 and the upper and lower horizontal conductor elements 3 and 4 together form a quasi-toroidal envelope which substantially surrounds the quasi-toroidal space defined above. Obviously the more turns that are used in the envelope, the more closely the actual electromagnetic field will extend throughout the entire quasi-toroidal space surrounded by the envelope. However, bearing in mind that tunnelling or drilling is required for the introduction of each of the conductor elements into an underground carbon deposit, a trade off must be made between efficiency of generation of the electromagnetic field within the quasi-toroidal space and the economics obtained by minimizing the number of holes or tunnels drilled or excavated. In the discussion which follows it will be assumed that the number of turns of the quasi-toroidal coil is twelve. However, some other number of turns may be utilized in appropriate situations, and empirical evaluation of the effectiveness of the number of turns initially employed will undoubtedly be made in particular applications to determine whether a greater or fewer number of turns may be suitable. Obviously additional tunnels and drill holes can be provided to increase the number of turns as required. Since the detailed design in no way affects the principles herein disclosed, the examples shown in the drawings must not be considered unique.

Figure 8:
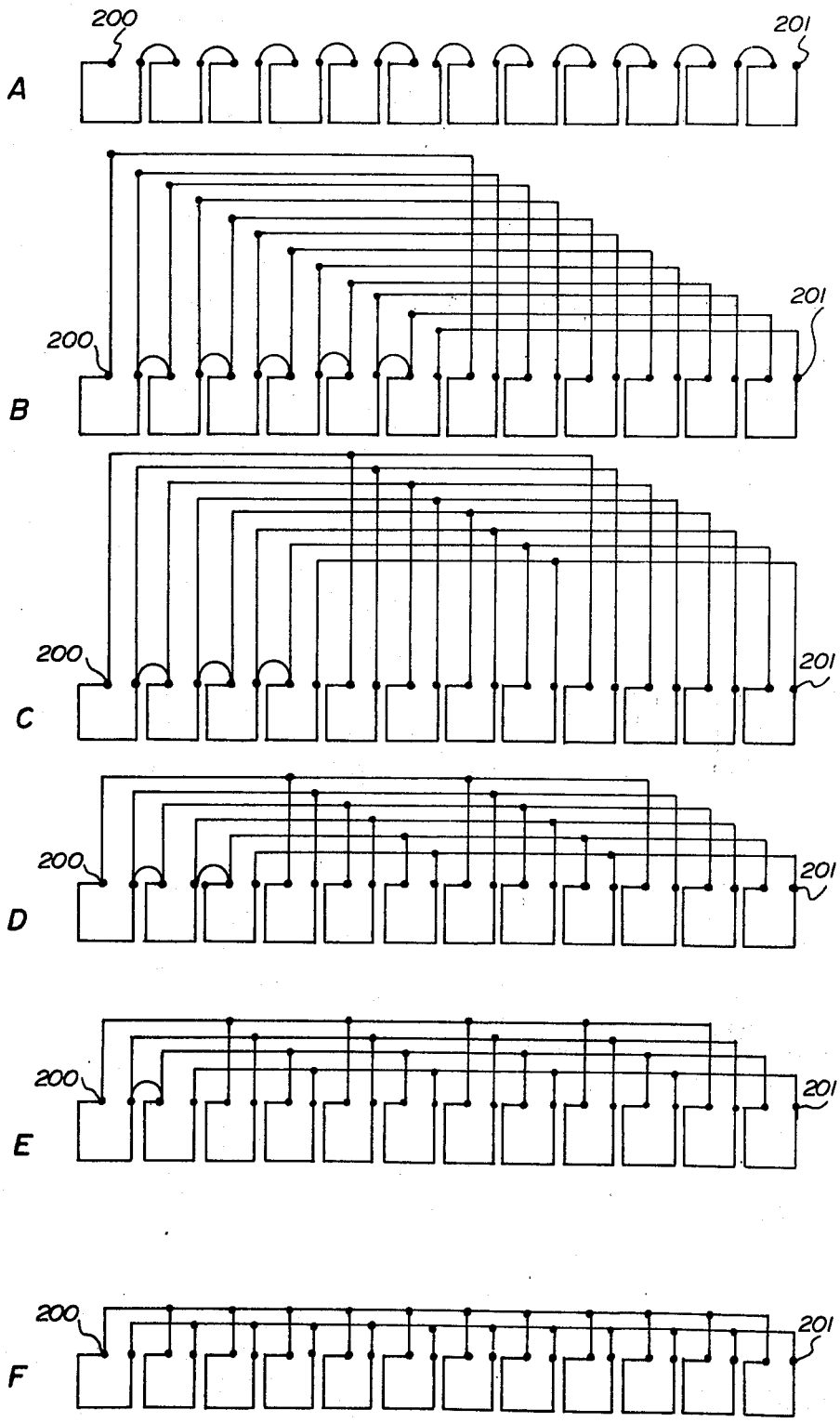
FIG. 8 is a schematic diagram illustrating six optional schematic interconnection arrangements of the conductive paths of FIG. 7.

The surface interconnection unit 22 of turns of the coil of FIG. 1 is elaborated upon in FIG. 8. Numerals 200 and 201 correspond to the input to the surface interconnections 22 of FIG. 1.

FIG. 8 shows in schematic form the twelve turn coil of FIG. 7, with the turns connected in six possible ways. In detail A the twelve turns are connected in series, as in FIG. 7; in detail B six series connections each of two turns in parallel are provided; in detail C, four series connections each of 3 turns in parallel; in detail D, 3 series connections each of 4 turns in parallel; in detail E, 2 series connections each of 6 turns in parallel; and in detail F a single path of twelve turns in parallel. The tabulation below shows that these provide a relative inductance range of 144 to 1, (and therefore a relative resonating capacitance range of 1 to 144) and this wide range permits convenient choices of other circuit parameters in a great variety of coal deposits.

| Turn Connections | Relative Inductance | Relative Max Currents | Relative Resistance |
|---|---|---|---|
| A | 144 | 1 | 144 |
| B | 36 | 2 | 36 |
| C | 16 | 3 | 16 |
| D | 9 | 4 | 9 |
| E | 4 | 6 | 4 |
| F | 1 | 12 | 1 |

Figure 9:
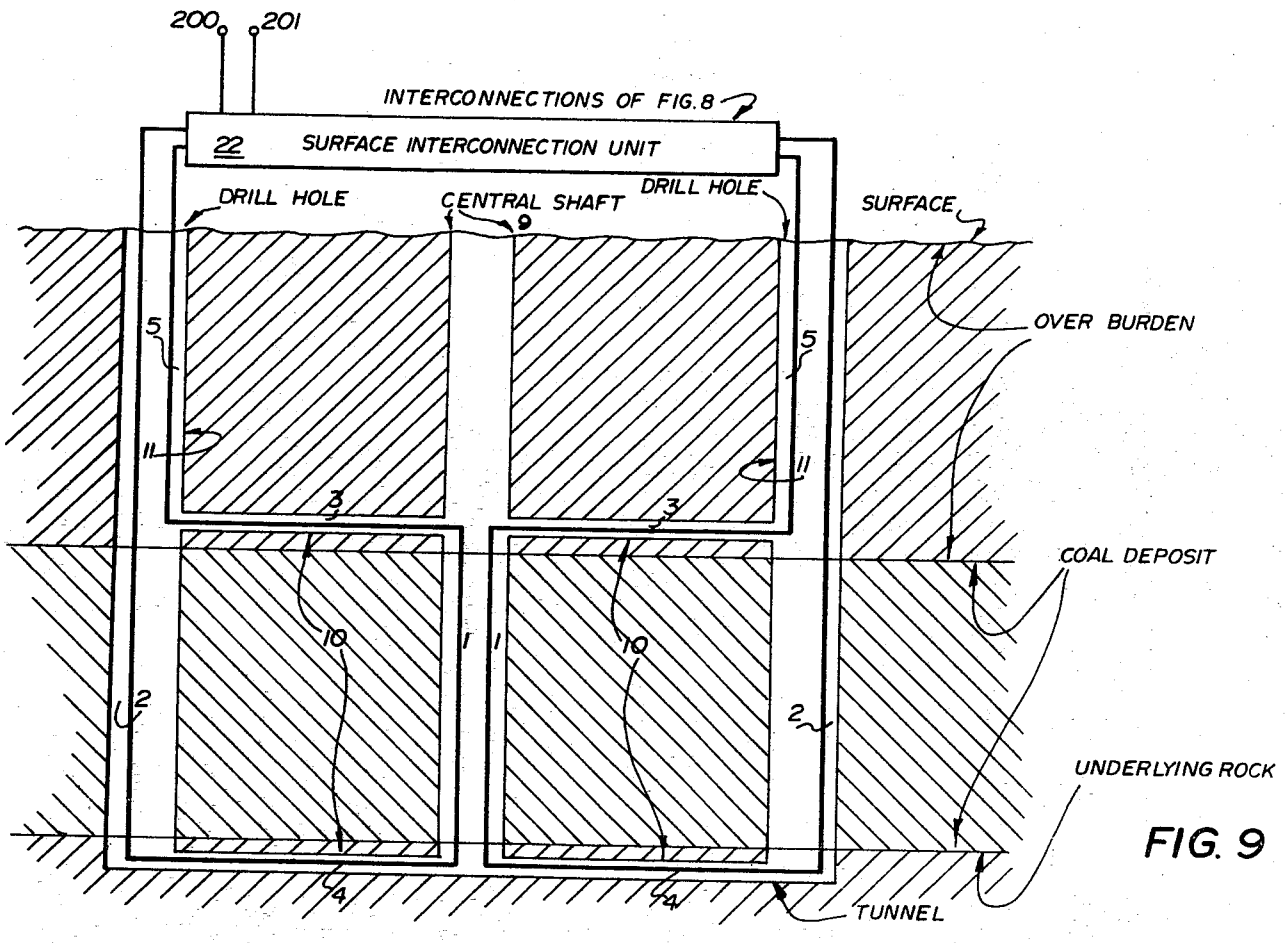
FIG. 9 is a schematic elevation view of two turns of a quasi-toroidal underground coil, with the connections to the surface sited components of the system.

FIG. 9 shows a schematic elevation view of two turns of the coil in FIG. 8 with the central vertical shaft 9, the horizontal tunnels 10, and the vertical drill holes 11 through which the conductors are threaded. The surface interconnection unit 22, drawn from one of the options of FIG. 8, is also shown.

Figure 10:
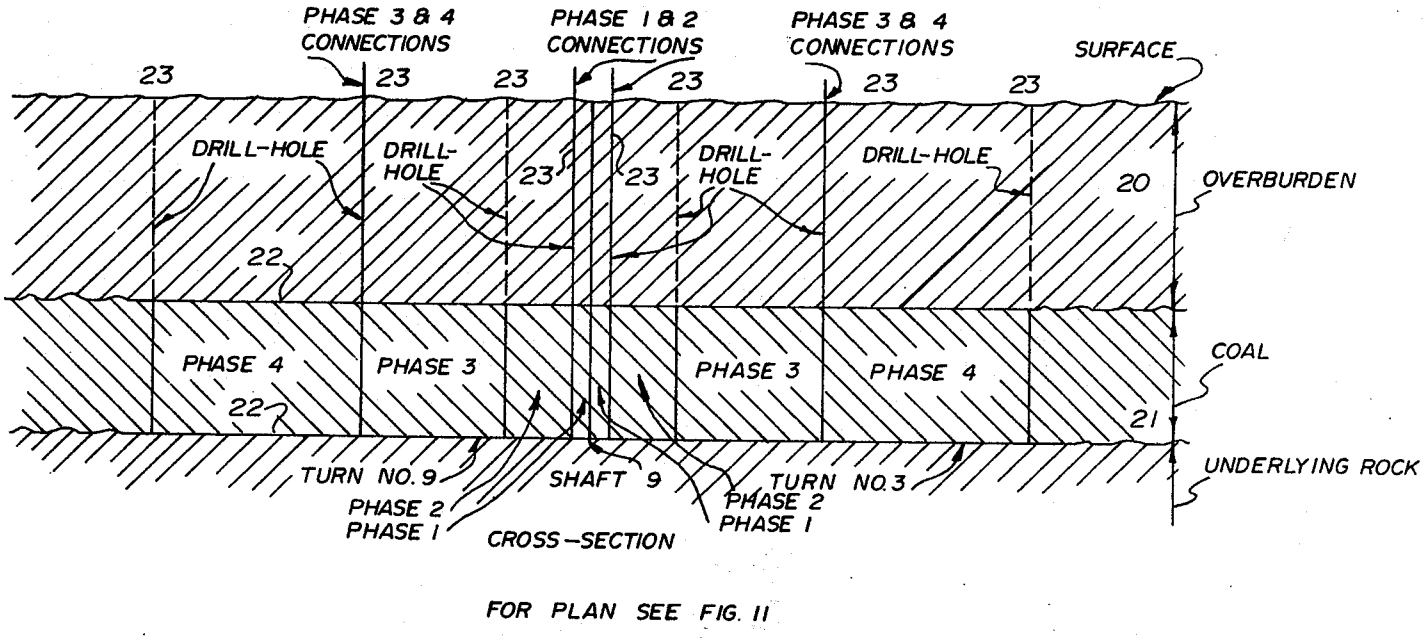
FIG. 10 is a schematic elevation view of a typical quasi-toroidal conductor path where the heating is carried out in four successive stages.

The resistivity of dry coals at 20° C. ranges from $10^{10}$ to $10^{14}$ ohm cm. However, the resistivity decreases exponentially with temperature and reaches about 5 ohm cm at 900° C. It may be useful to take advantage of this property of coal before induction heating is initiated. Referring to FIG. 9, oxygen or other suitable gas or liquid is injected at the inner face of the portion of the deposit to be heated. Here, the central shaft 9 of FIG. 9 or drill holes 23 (as seen in FIG. 10) at the inner radius of a quasi-toroidal coil would be so injected. Next, the coal along the inner face or drill holes is ignited. This reduces the resistivity of the coal at the drill hole or inner face. Thus, when induction heating is commenced, by applying current to the turns of the coil, large currents will flow more readily because of the greatly reduced resistivity. The induction heating will then spread outwardly from the inner face or drill holes so ignited and heated. In FIG. 9, this would be from shaft 9 outwards.

For the reasons previously discussed, there is a practical upper limit on the ratio of the outer radius of the quasi-toroidal envelope defined by the vertical conductors 2 of FIG. 9 to the inner radius of the quasi-toroidal envelope defined by the location of the inner vertical conductor segments 1 of FIG. 9. For this reason it may be desirable to provide a further quasi-toroidal envelope surrounding that illustrated in FIGS. 7 or 9. Such further quasi-toroidal envelope could utilize as its innermost vertical conductor elements the conductor elements 2 of FIGS. 7 or 9. Mathematical studies have shown that the ratio of the outer radius of the quasi-toroidal envelope to the inner radius of the quasi-toroidal envelope should not be greater than about 5 or 6 for best results. If this limit is observed, the efficiency of the induction heating process is greatly increased, since the ohmic losses in the coil conductors are kept to a low value, and the energy is principally expended in heating the coal.

FIG. 10 is a schematic elevation view of the conductor paths which may be used for a four phase coal heating operation. A central shaft 9 of radius about five feet is sunk from the surface through the overburden 20, and through the coal deposit 21. Two sets of equally spaced radial horizontal tunnels 22 of say 40 inch diameter are drilled from the central shaft 9. One set of radial horizontal tunnels 22 is located at the upper face of the coal deposit 21. The second set of horizontal tunnels 22 is located at the lower face of the coal deposit 21. Next, four sets of vertical drill holes 23 are sunk from the surface through to the bottom of the coal deposit 21. Each set consists of twelve vertical drill holes 23 equally spaced about the circumference of a circle and located so as to intersect the upper and lower horizontal tunnels 22. Each vertical drill hole has a radius of about 16 inches. The number of sets of vertical drill holes is dependent upon the extent of the coal deposit. For illustrative purposes, four sets have been described here.

Figure 11:
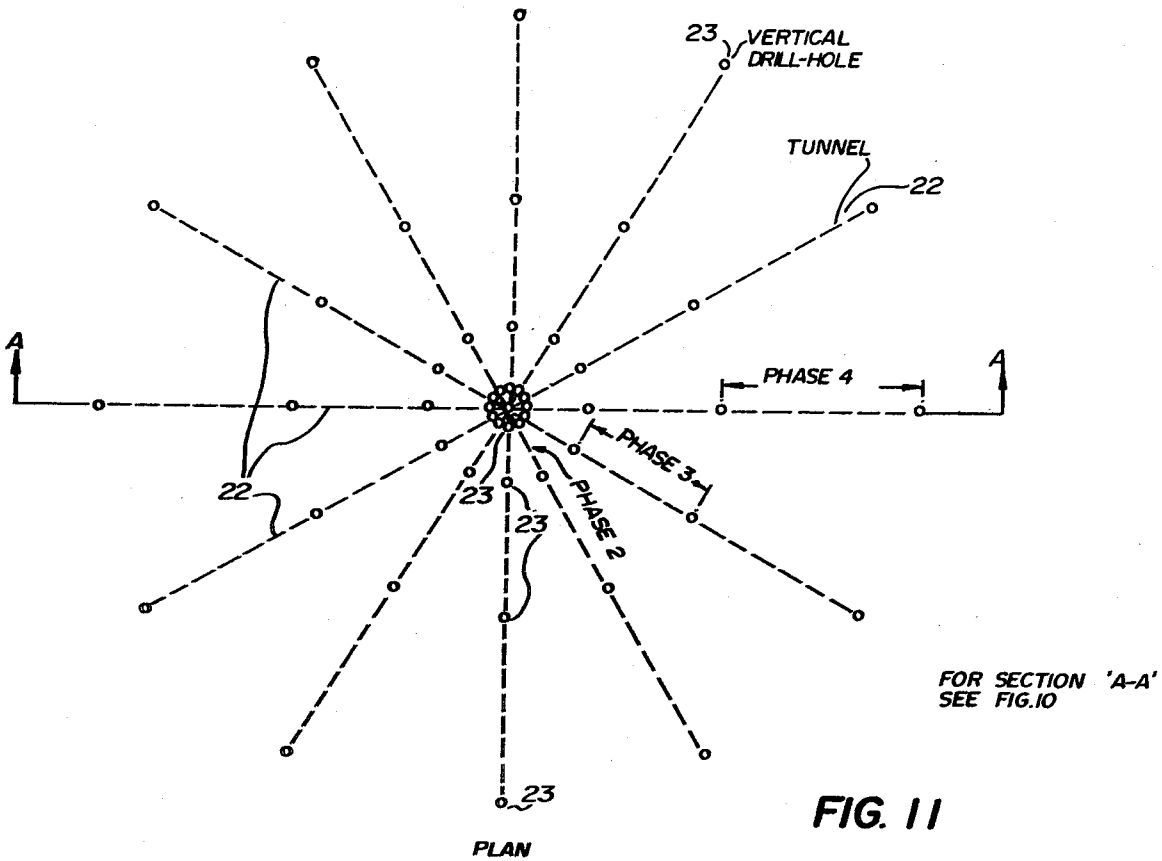
FIG. 11 is a schematic plan view of a typical quasi-toroidal conductor path of FIG. 10, showing the disposition of the conductors underground in the shaft, tunnels, and drill holes, for the heating of the coal deposit.

FIG. 11 is a schematic plan view of the configuration of FIG. 10 illustrating the vertical drill holes 23. Four sets of vertical drill holes 23 are depicted. The inner set of twelve vertical drill holes 23 lies upon the circumference of a circle of radius 20–30 feet. The second set lies on a circle of radius 100–200 feet; the third set on a circle of radius 500–1200 feet and the fourth set on a circle of radius about 2500–7200 feet. The dashed lines of FIG. 11 show the horizontal tunnels 22. There are twelve such tunnels at the upper face of the coal deposit and twelve more at the lower face. Obviously, both sets of tunnels cannot be shown in a plan view.

Figure 12:
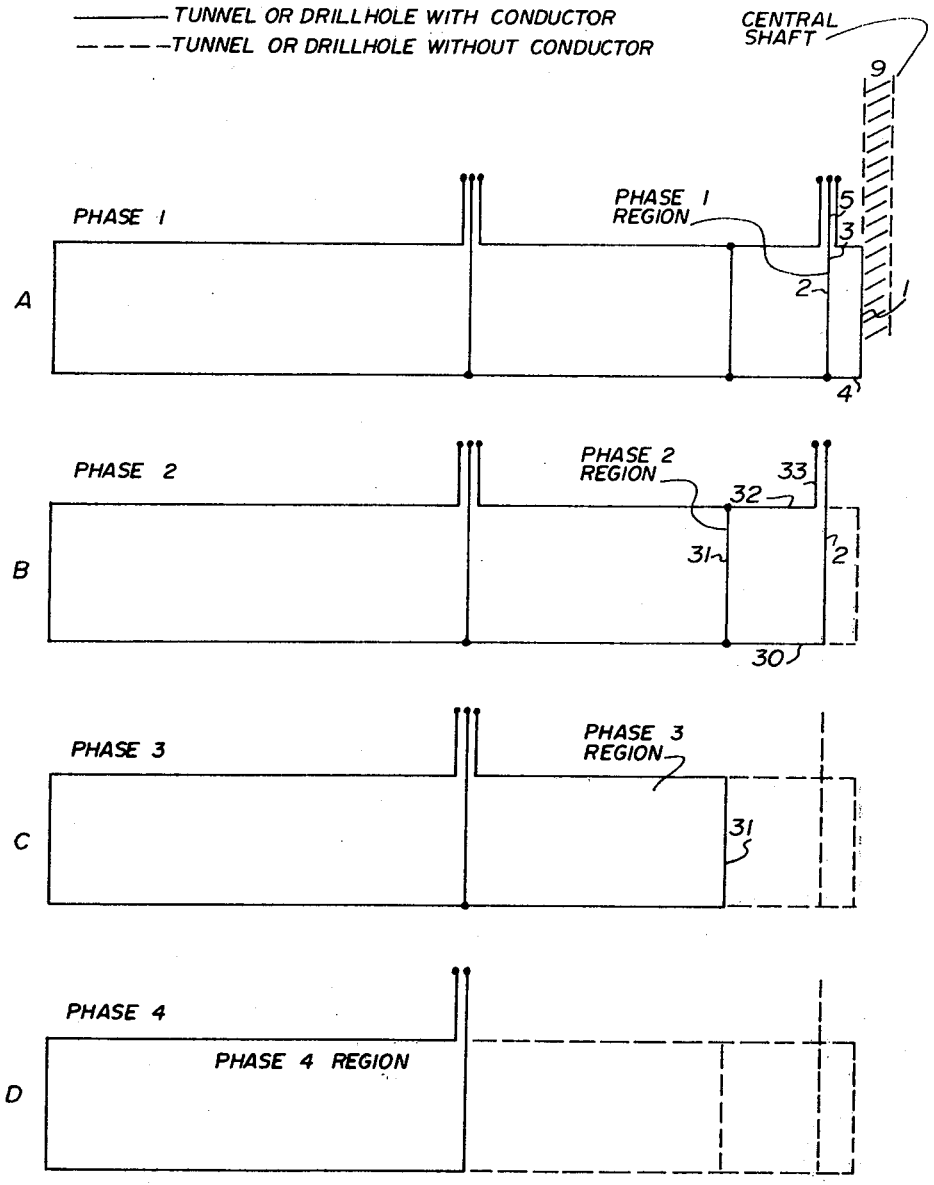
FIG. 12 is a schematic elevation view of the configuration of FIG. 11.

FIG. 12 is a schematic elevation view showing the conductors of one turn of the coil within the vertical drill holes, central shaft and horizontal tunnels. The cross-hatched area 9 depicts the central shaft. The solid lines illustrate a conducting element located within a horizontal tunnel, vertical drill hole or central shaft. A dashed line represents such a tunnel, drill hole or central shaft with no conductor.

With respect to detail A of FIG. 12 a single turn of the coil is shown. It is preferable to install the conductors for all four phases of the coal heating operation before beginning to heat the first phase. In the first phase, represented by detail A, the inner vertical conductor segment 1 is connected to the lower horizontal conductor segment 4. Segment 4 is connected to outer vertical conductor segment 2. Vertical conductor segment 1 is connected to upper horizontal conductor 3 and the latter is connected to vertical conductor segment 5. Conductors 2 and 5 are connected to the surface connection arrangement of FIG. 8. The inner radius of the phase 1 coil is about five feet corresponding to the radius of the vertical central shaft 9. The outer radius of the phase 1 coil is 20–30 feet. Power is applied to the coil to initiate the heating of the coal.

When heating of the coal deposit lying within the conductor segments 5, 3, 1, 4 and 2 has been completed, phase 1 of the coal heating operation is finished and phase 2 shown in detail B of FIG. 12 may be begun. In detail B of FIG. 12 conductor segments 2, 30, 31, 32 and 33 are connected so as to form one turn of the electrical induction coil. The phase 2 coil has an inner radius of 20–30 feet and an outer radius of 150–200 feet. Note that conductor segment 2 is used for both phase 1 and phase 2.

In a similar fashion, the necessary changes being made, phase 3 and 4 follow phases 1 and 2. Detail C and detail D of FIG. 12 illustrate the interconnection of the conductors for phases 3 and 4. As each phase is completed, the conductors unused in the preceding stage may if desired be disconnected and withdrawn for use elsewhere. It will be noted that the coil connections are brought out at each second drill hole along the radius shown in FIG. 12. The changing of connections between successive phases is therefore facilitated. The arrangement of the installation in a concentric configuration has two important advantages: it permits the utilization of the vertical drill holes and coil conductors twice, for the outer conductors of one stage and the inner conductors of the succeeding stage; and heat transmitted outwardly from any phase is utilized in the succeeding phase. It will be noted that no coil connections are made at the upper end of the central shaft 9 of FIG. 11. This is desirable, since this shaft among others is utilized for the eduction of the gas, and other products which result from the heating of coal. If necessary, other vertical drill holes could be sunk to provide paths for the removal of the gases.

Figure 13:
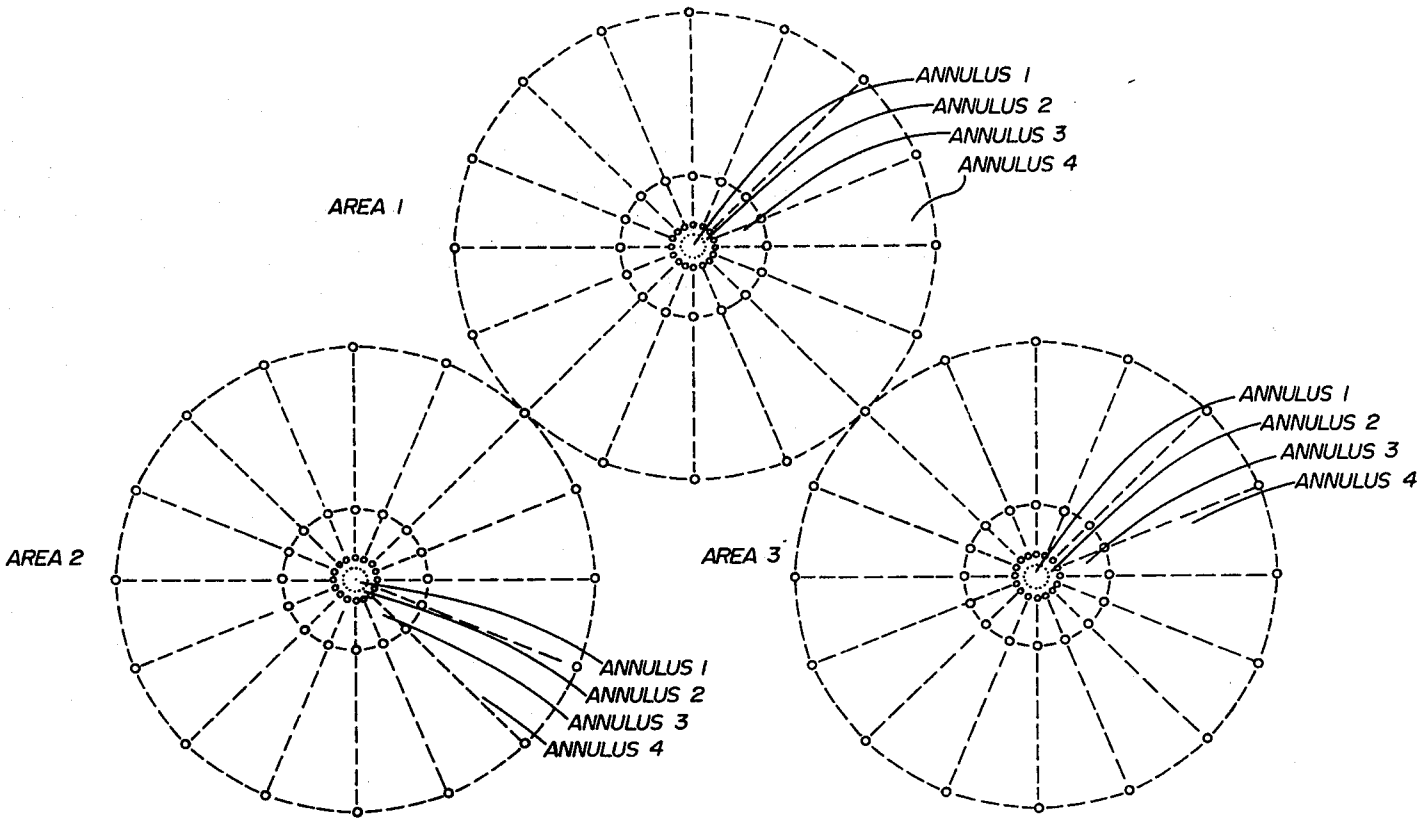
FIG. 13 schematically illustrates a grid arrangement on the surface of the earth for the practice of a preferred heating technique according to the invention.

FIG. 13 is a schematic plan view of a method for heating an extensive region of an underground coal deposit which involves the simultaneous, sequential, or simultaneous and sequential heating of two or more portions of a deposit. By way of example, four sets of concentric underground coils as discussed above with reference to FIGS. 10, 11 and 12 are shown. Each set is placed within a circular area, area 1, area 2 and area 3. Here, by way of example, a sixteen turn coil is shown. The small circles show the vertical drill holes 23 of FIG. 11. The dotted straight lines depict underground horizontal tunnels 22 of FIG. 11. The four annular regions are also shown by way of example.

Within each area, heating will progress outwardly into the coal deposit by changing the coil connections found in FIG. 12. It is thus seen that the use of four sets of concentric coils permits a much larger volume of coal to be heated than would be the case if only one area at a time is processed.

For the sake of completeness, a possible extraction method for use with the invention will now be described. The particular extraction method chosen is at the discretion of the user and is not a part of this invention per se.

Coal and lignite are classed as intrinsic semiconductors, as are the other fossil fuels-oil-sand, oil-shale, petroleum, etc., and have the electrical conductivity (or resistivity) variations characteristic of this class of materials. The specific electrical resistivity of all dry coals is extremely high at 20° C. in the range of $10^{10}$ to $10^{14}$ ohm cm, with the anthracites near the upper limit and the lignites near the lower limit. The resistivity decreases exponentially with the absolute temperature, and for all coals reaches a value of the order of 5 ohm cm at about 900° C. temperature. In order to heat coal effectively by